United States Patent [19]

Ara

[11] Patent Number: 4,929,937

[45] Date of Patent: May 29, 1990

[54] CIRCUIT FOR GENERATING IMAGE SIGNAL

[75] Inventor: Kouichi Ara, Osaka, Japan

[73] Assignee: NEC Home Electronics Ltd., Osaka, Japan

[21] Appl. No.: 160,375

[22] Filed: Feb. 25, 1988

[30] Foreign Application Priority Data

Feb. 27, 1987 [JP] Japan ..... 62-44599

[51] Int. Cl.[5] ..... G09G 1/16

[52] U.S. Cl. ..... 340/728; 358/10; 358/139

[58] Field of Search ..... 340/728; 358/60, 139, 358/140, 231, 239, 10; 382/22, 56; 434/3, 4; 353/30, 31

[56] References Cited

U.S. PATENT DOCUMENTS 4,020,462 4/1979 Morrin, II ..... 340/728
4,364,090 12/1982 Wendland ..... 340/728
4,631,691 12/1986 Pica ..... 340/728
4,646,076 2/1987 Wiedenman et al. ..... 340/728
4,656,507 4/1987 Greaves et al. ..... 340/728
4,794,387 12/1988 Sanders, Jr. ..... 340/728
4,809,350 2/1989 Shimoni et al. ..... 382/56

*Primary Examiner*—David K. Moore
*Assistant Examiner*—M. Fatahiyar
*Attorney, Agent, or Firm*—Cushman, Darby & Cushman

[57] ABSTRACT

A circuit for generating an image signal having an image pattern creating device for successively reading data from a memory in step with a deflection operation. The image pattern creating creates an image pattern consisting of dots, the minimum width of which is determined by the storage capacity of the memory. A compressor detects the horizontal edges of the image pattern and delays the horizontal edges by a period shorter than the period corresponding to the minimum width of the dots thereby compressing the width of the dots.

7 Claims, 2 Drawing Sheets

OUTPUT FROM CONVERTER 7

OUTPUT FROM BLANKING CIRCUIT 12

OUTPUT FROM DETECTING CIRCUIT 14

OUTPUT FROM DETECTING CIRCUIT 13

OUTPUT FROM ADDER 15

CIRCUIT FOR GENERATING IMAGE SIGNAL

BACKGROUND OF THE INVENTION

The present invention relates to an image signal-generating circuit which horizontally compresses dots which form an image pattern.

Projection TV receivers have larger viewing screens that TV receivers which are directly viewed. The clearness of the image formed on such a projection TV receiver is not sharp because red, green and blue scanning lines are not in focus. Therefore, when the direction of the projection tube is changed or its altitude is adjusted, it is necessary to achieve convergence using an adjusting image pattern, such as a crosshatch pattern or dot pattern. Where an image signal-generating circuit for generating an image pattern used for achieving convergence is fabricated entirely of hardware, various circuits must be provided for different image patterns. This makes the configuration of the circuit complex. If a cursor is to be displayed on the viewing screen, the circuit is more complex. Consequently, this approach is impractical.

Accordingly, an improved method has been introduced. This method is now described by referring to FIG. 3, where an image signal-generating circuit is generally indicated by reference numeral 1. The circuit 1 includes a memory 2 in which information about one field or one frame of image is stored. The image pattern read from the memory 2 is supplied to a video-processing circuit 4 included in a projection TV receiver 3. The signal-generating circuit 1 also includes a central-processing unit 5 to which the memory is connected. An address-generating circuit 6, also incorporated in the circuit 1, operates in phase with a horizontal synchronizing signal. Data is read from the memory 2 at addresses specified by the address-generating circuit 6 and fed to the video-processing circuit 4 via a converter circuit 7. Converter circuit 7 converts parallel data into serial form. The image information stored in the memory 2 can be altered at will within the capacity of the memory 2 by making use of the image-drawing function of the central-processing unit 5.

When the aforementioned image signal-generating circuit 1 displays a crosshatch pattern, for example, on the viewing screen, each horizontal line can be drawn at the width of one line, but the width of each vertical line is larger because of the restricted storage capacity of the memory 2. Therefore, restrictions are imposed on the minimum width of dots which can be realized in software due to the storage capacity of memory 2. Thus, it is difficult to make the width of the vertical line substantially equal to the width of the horizontal line. A check is performed to see if the red, green and blue scanning lines are out of focus while viewing a rectangular portion surrounded by vertical and horizontal lines which intersect at four points, in order to attain convergence. For the above reason, it is difficult to obtain an image pattern best suited for this check operation.

SUMMARY OF THE INVENTION

It is an object of the present invention to provide an image signal-generating circuit which generates an image consisting of dots wherein the horizontal width of the dots is compressed.

It is a feature of the present invention that a compressing means detects the horizontal edges of an image pattern and delays the detected edges by a period shorter than the period corresponding to the width of dots which form the image pattern.

It is another feature of the present invention that the image is stored in software and the horizontal width of the dots which form the image is compressed by hardware.

It is an advantage of the present invention that the width of dots forming an image can be compressed without increasing the storage capacity of the memory.

These and other objects of the invention are achieved by a circuit comprising a memory in which data about an image is stored; an image pattern-creating means for successively reading data from the memory in step with a deflection operation and for creating an image pattern consisting of dots the minimum width of which is determined by the storage capacity of the memory; and a compressing means which receives data from the memory, detects the horizontal edges of the image pattern, and delays the detected horizontal edges by a period shorter than the period corresponding to the minimum width of the dots to compress the width of the dots forming the image pattern.

In accordance with the invention, data about an image is successively read from the memory in step with the deflection. An image pattern consisting of dots the minimum width of which is determined by the storage capacity of the memory is created. The horizontal edges of the image pattern are detected, based on the data read from the memory. The detected edges are delayed by a period shorter than the period corresponding to the minimum width of the dots, in order to compress the width of the dots forming the image pattern.

DETAILED DESCRIPTION OF THE PREFERRED EMBODIMENT

Figure 1:
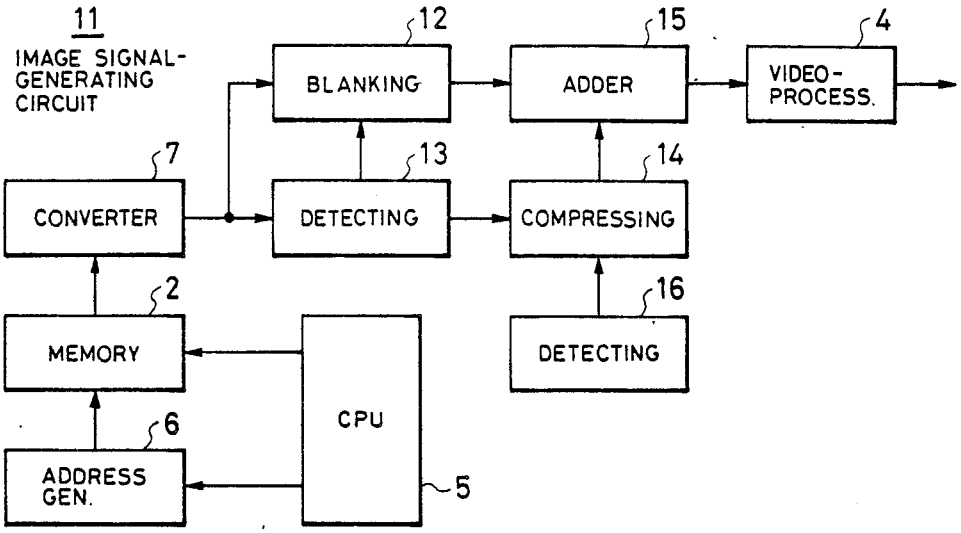
FIG. 1 is a circuit diagram of an image signal-generating circuit according to the invention.
Figure 2A:
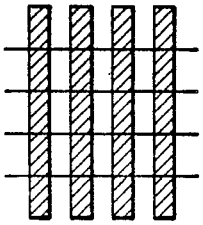
FIGS. 2(A)–2(E) image patterns displayed on a viewing screen, based on signals produced at various portions of the circuit shown in FIG. 1.
Figure 2B:
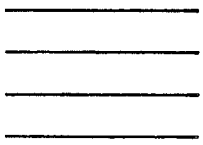
Figure 2D:
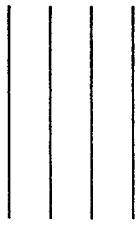
Figure 2C:
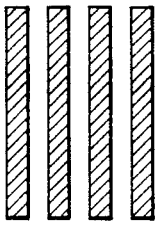
Figure 2E:
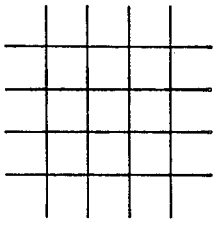
Figure 3:
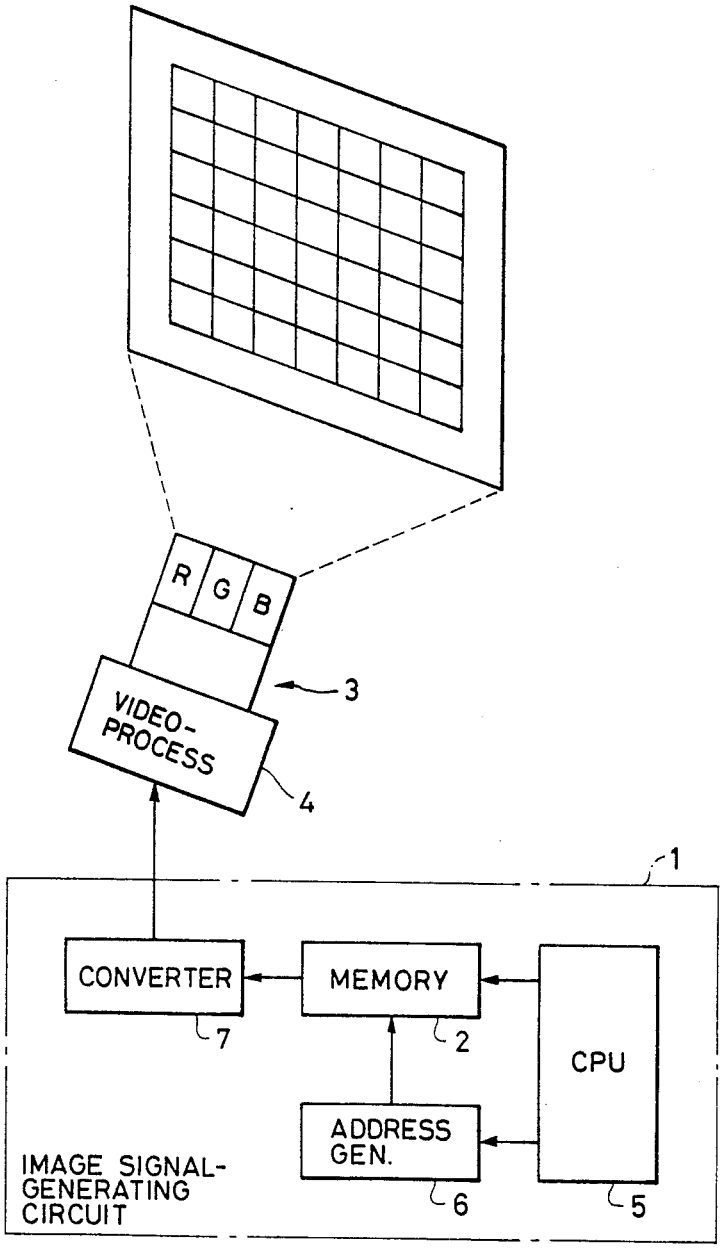
FIG. 3 PRIOR ART
FIG. 3 is a circuit diagram of a conventional image signal-generating circuit.

One embodiment of the invention is hereinafter described with reference to FIGS. 1 and 2. FIG. 1 is a circuit diagram of an image signal-generating circuit according to the invention. FIG. 2 shows image patterns displayed on a viewing screen, based on signals produced in various sections of the circuit shown in FIG. 1.

Referring to FIG. 1, an image signal-generating circuit 11 has a parallel-to-serial converter circuit 7, a video-processing circuit 4, and a width compressing means disposed between the converter circuit 7 and the video-processing circuit 4. The compressing means detects the horizontal edges of an image pattern and delays the detected edges by a period shorter than the period corresponding to the aforementioned width of dots, thereby compressing the width of the dots. In the embodiment depicted in the FIGURES, the compressing means comprises a vertical line-detecting circuit 13 for extracting only vertical lines from a crosshatch pattern received from converter 7, a vertical line blanking circuit 12 for deleting the vertical lines detected by the detecting circuit 12 from the crosshatch pattern received from converter 7, a vertical line width compressing circuit 14 for creating narrower vertical lines, based on the vertical lines detected by the detecting circuit 13, and an adder circuit 15 for adding the narrower vertical lines received from the compressing circuit 14 to the image received from the vertical line blanking circuit 12. The narrower vertical lines created by the compressing circuit 14 have the same leading edges as the leading edges of the vertical lines detected by the detecting circuit 13. In this example, the compressing circuit 14 consists of a delay circuit or the like which is triggered by the horizontal edges of an image pattern and produces a delayed output having a certain duration. A horizontal deflection frequency detecting circuit 16 is connected to the vertical line width compressing circuit 14 to reduce the delay time with the increase of the horizontal deflection frequency.

Image patterns created by the outputs from the various circuits constituting the width compressing means are shown in FIG. 2, (A)-(E). As can be seen from these figures, the vertical lines forming the crosshatch pattern obtained from the adder circuit 15 have been narrowed by the compressing circuit 14 so as to have a width substantially equal to the width of the horizontal lines. If the vertical lines are processed only in software, the minimum width is not reduced sufficiently because of the limited storage capacity of memory 2. In this novel circuit, the width can be reduced to a desired width by hardware. Accordingly, when an image pattern is displayed on a high definition display whose horizontal deflection frequency is about twice as high as the ordinary deflection frequency, the delay time introduced by the vertical line width compressing circuit 14 is reduced by a factor of about two according to the horizontal deflection frequency. Hence, the width of the vertical lines can be maintained substantially equal to the width of the horizontal lines.

The width of dots forming the image pattern narrowed by the compressing means is not limited to a crosshatch pattern. For example, a dot pattern or a circular pattern may be processed similarly. Further, a cursor or the like can be readily displayed by taking advantage of the processing in software.

In this way, the image signal-generating circuit 11 successively reads data about an image from the memory 2 in step with the deflection, forms an image pattern out of dots the minimum width of which is determined by the storage capacity of the memory 2, detects the horizontal edges of the pattern, based on the data read from the memory 2, and delays the detected edges by a period shorter than the period corresponding to the minimum width of dots, thereby reducing the width of the dots forming the pattern. The horizontal resolution that is restricted by the storage capacity of the memory 2 is enhanced not by enlarging the storage capacity of the memory 2, but by modifying the shape of the waveform of the image pattern read from the memory 2 on the time base. Consequently, software processing adapted for processing of the whole image pattern and hardware processing suitable for processing of details of the image pattern are used simultaneously while making use of their characteristics. Hence, images can be processed quite efficiently.

While the invention has been described in connection with what is presently considered to be the most practical and preferred embodiment, it is to be understood that the invention is not limited to the disclosed embodiment but, on the contrary, is intended to cover various modifications and equivalent arrangements included within the spirit and scope of the appended claims. Therefore, persons of ordinary skill in the field are to understand that all such equivalent structures are to be included within the scope of the following claims.

What is claimed is:

1. A circuit for generating an image signal for use in a projection TV receiver, comprising:

a memory means in which data about an image is stored;

an image pattern creating means for successively reading data from the memory means in step with a deflection operation and for creating an image pattern consisting of dots the minimum width of which is determined by the storage capacity of the memory; and a compressing means which receives data from the image pattern creating means and compresses the width of the dots forming the image pattern, said compressing means including a detecting means to detect the horizontal edges of the image pattern and delaying means to delay the horizontal edges by a period shorter than the period corresponding to the minimum width of the dots.

2. A circuit as in claim 1, wherein said image creating means includes a converter means to convert parallel data received from the memory means to a serial form.

3. A method to compress horizontal edges of an image received from a memory means comprising the steps of:

initially removing the vertical lines from the image;

compressing the horizontal edges of the vertical lines which have been removed from the image; and subsequently adding the compressed vertical lines to the image from which the vertical lines were initially removed.

4. A method as in claim 3, wherein said compressing step comprises the steps of:

detecting the horizontal edges of the image pattern; and delaying the detected horizontal edges by a period shorter than the period corresponding to the minimum width of the dots.

5. A circuit as in claim 1, wherein said circuit is used with a projection television system.

6. A circuit as in claim 1, wherein said compressing means comprises:

means for extracting vertical lines from the image pattern;

means for creating narrower vertical lines, from the vertical lines extracted; and means for adding the narrower vertical lines to the image pattern from which the vertical lines have been extracted.

7. A circuit as in claim 6, wherein said adding means includes means for giving said narrower vertical lines a same leading edge as the original vertical lines.

* * * * *